US006145551A

United States Patent [19]

Jayaraman et al.

[11] Patent Number: 6,145,551

[45] Date of Patent: Nov. 14, 2000

[54] FULL-FASHIONED WEAVING PROCESS FOR PRODUCTION OF A WOVEN GARMENT WITH INTELLIGENCE CAPABILITY

[75] Inventors: Sundaresan Jayaraman, Atlanta; Sungmee Park, Tucker; Rangaswamy Rajamanickam, Atlanta, all of Ga.

[73] Assignee: Georgia Tech Research Corp.

[21] Appl. No.: 09/157,607

[22] Filed: Sep. 21, 1998

Related U.S. Application Data

[60] Provisional application No. 60/059,444, Sep. 22, 1997.

[51] Int. Cl.[7] ..... D03D 3/02

[52] U.S. Cl. ..... 139/387 R; 139/55.1; 2/905; 2/455

[58] Field of Search ..... 159/388, 55.1, 159/387 R, 387; 128/644, 639; 428/68, 196, 257, 195, 36; 2/455, 905, 102, 243

[56] References Cited

U.S. PATENT DOCUMENTS

| | | | |
|---|---|---|---|
| 2,579,383 | 12/1951 | Goudsmit . | |
| 2,935,096 | 5/1960 | Cole . | |
| 3,020,935 | 2/1962 | Balis . | |
| 3,409,007 | 11/1968 | Fuller . | |
| 3,970,116 | 7/1976 | Takada et al. | 139/387 R |
| 4,174,739 | 11/1979 | Rasero et al. | 139/388 |
| 4,299,878 | 11/1981 | Rheaume . | |
| 4,572,197 | 2/1986 | Moore et al. . | |
| 4,580,572 | 4/1986 | Granek et al. . | |
| 4,606,968 | 8/1986 | Thornton et al. . | |
| 4,668,545 | 5/1987 | Lowe . | |
| 4,727,603 | 3/1988 | Howard . | |
| 5,038,782 | 8/1991 | Gevins et al. | 128/644 |
| 5,103,504 | 4/1992 | Dordevic . | |
| 5,212,379 | 5/1993 | Nafarrate et al. . | |
| 5,316,830 | 5/1994 | Adams, Jr. et al. . | |
| 5,415,204 | 5/1995 | Kitamura | 139/55.1 |
| 5,436,444 | 7/1995 | Rawson . | |
| 5,592,977 | 1/1997 | Kikuchi et al. . | |
| 5,624,736 | 4/1997 | DeAngelis et al. . | |
| 5,636,378 | 6/1997 | Griffith . | |
| 5,694,645 | 12/1997 | Triplette . | |
| 5,843,554 | 12/1998 | Katz | 428/68 |

FOREIGN PATENT DOCUMENTS

| | | | |
|---|---|---|---|
| 2225560 | 11/1974 | France | 139/387 R |
| 826183 | 7/1949 | Germany | 139/387 R |

OTHER PUBLICATIONS

Slide Presentation Titled High Velocity Penetration Analysis from the DLA/ARPA/NRaD Sensate Liner Workshop held Apr. 11, 1996; Author: Dr. Robert Eisler, MRC., Inc.

Slide Presentation Titled Introducing Clarity Fit Technologies from the DLA/ARPA/NRaD Sensate LIner Workshop held Apr. 11, 1996; Author: Edith Gazzuolo, Clarity Inc.

Slide Presentation Tilted Silicone Rubber Fiber Optic Sensors from the DLA/ARPA/NRaD Sensate Liner Workshop held Apr. 11, 1996; Author: Jeffrey D. Muhs.

Slide Presentation Titled Vital Sign Sensing from the DLA/ARPA/NRaD Sensate Liner Workshop held Apr. 11, 1996; Author: Dr. Herman Watson, NIMS, Inc.

Slide Presentation Titled Sensate LIner Design & Development: Georgia Tech's Potential Contributions From the DLA/ARPA/NRaD Sensate LIner Workshop held Apr. 11, 1996; Author: Dr. Sundaresan Jayaraman.

(List continued on next page.)

*Primary Examiner*—John J. Calvert
*Assistant Examiner*—Robert H. Muromoto, Jr.
*Attorney, Agent, or Firm*—Todd Deveau; Ryan A. Schneider; Troutman & Sanders LLP

[57] ABSTRACT

A full-fashioned weaving process for the production of a woven garment which can accommodate and include holes, such as armholes. The garment is made of only one single integrated fabric and has no discontinuities or seams. Additionally, the garment can include intelligence capability, such as the ability to monitor one or more body vital signs, or garment penetration, or both, by including a selected sensing component or components in the weave of the garment.

43 Claims, 9 Drawing Sheets

OTHER PUBLICATIONS

Slide Presentation Titled DEfense Logistics Agency Apparel Research Network Sensate Liner Workshop from DLA/ARPA/NRad held Apr. 11, 1996; Author: Donald O'Brien, Technical Enterprise Team.

Slide Presentation Titled TPSS/Senste Liner Technology Develop–ment from the DLA/ARPA/NRaD Sensate Liner Workshop held Apr. 11, 1996; Author Dr. Eric J. LInd.

Slide Presentation Titled Smart Textiles from the DLA/ARPA/NRaD Sensate Liner Workshop held Apr. 11, 1996; Author: Dr. Michael Burns, SME, Inc.

Slide Presentation Titled Personal Status Monitor from the DLA/ARPA/NRaD Sensate Liner Workshop held Apr. 11, 1996; Author: Lt. Gen. Peter Kind (Ret.), Sarcos.

Slide Presentation Tilted Combat Casualty Care Overview from the DLA/ARPA/NRaD held Apr. 11, 1996; Author: Col. R. Satava ARPA.

Slide Presentation Titled Resources Available Through The Apparel Center At Southern Tech from the Sensate Liner Workshop held Apr. 11, 1996; Author: Dr. Larry Haddock, Southern Tech.

Slide Presentation Titled Introduction: Anthropology Research Project from the DLA/ARPA/NRaD Sensate Liner Workshop held Apr. 11, 1996; Author: Dr. Bruce Bradtmiller.

Slide Presentation Titled Applications For 3D Human Body Modelling from the DLA/ARPA/NRaD Sensate Liner Workshop held Apr. 11, 1996; Author: Dr. Robert M. Beecher, Beecher Research Company.

Slide Presentation Titled Prototype Development of Functional Clothing Research from the DLA/ARPA/NRaD Sensate Liner Workshop held Apr. 11, 1996; Author: Donna Albrecht, Univ. of Wisconsin.

Slide Presentation Titled An Overview of Clemson Apparel Research from the DLA/ARPA/NRaD Sensate Liner Workshop held Apr. 11, 1996; Author: Dr. Chris Jarvis, Clemson Apparel Research.

Slide Presentations from Proposal conference for the Sensate Liner For Combat Casualty Care Program dated Jun. 27, 1996.

| MATERIAL | ENDS PER INCH | PICKS PER INCH |
|---|---|---|
| PLASTIC OPTICAL FIBER 24 | 0 | 5.5 |
| ELECTRICAL CONDUCTING FIBER 25 | 0.5 | 0.5 |
| CORE-SPUN SPANDEX WITH MICRODENIER POLYESTER & COTTON 26 | 0 | 1 |
| NEGA-STAT 28 | 0.5 | 0 |
| MERAKLON/POLYESTER &COTTON 22 | 39 | 47 |

200 DENIER X-STATIC SILVER COATED NYLON CONDUCTIVE THREAD 25

CORE-SPUN/SHEATHED PLASTIC OPTICAL FIBER 24

HIGH RESISTANT FIBERS 43
BASIC GRID (LOW RESISTANT FIBER) 42
DATA BUS 47
RANDOMLY POSITIONED INTERCONNECTED POINTS 48
ELASTIC OPTICAL FIBER SENSOR 41
POWER 44
GROUND 46

FULL-FASHIONED WEAVING PROCESS FOR PRODUCTION OF A WOVEN GARMENT WITH INTELLIGENCE CAPABILITY

This application claims the benefit of U.S. Provisional No. 60/059,444 filed Sep. 22, 1997.

This invention was made with government support under Contract No. N66001-96-C-8639 awarded by the Department of the Navy. The government has certain rights in this invention.

BACKGROUND OF THE INVENTION

1. Field of the Invention

The present invention relates to a full-fashioned weaving process for the production of a woven garment which can accommodate and include holes, such as armholes. The garment is made of only one single integrated fabric and has no discontinuities or seams. Additionally, the garment can include intelligence capability.

2. Background of the Art

In weaving, two sets of yarns—known as warp and filling yarns, respectively—are interlaced at right angles to one another on a weaving machine or loom. Traditional weaving technologies typically produce a two-dimensional fabric. To fashion a three-dimensional garment from such a woven fabric requires cutting and sewing of the fabric.

Tubular weaving is a special variation of traditional weaving in which a fabric tube is produced on the loom. However, tubular weaving, up until now has not been available to produce a full-fashioned woven garment, such as a shirt, because it was unable to accommodate discontinuities in the garment, such as armholes, without requiring cutting and sewing.

A need, therefore, exists for a process to produce a full-fashioned woven garment which eliminates the need for cutting and sewing fabric parts to fashion the garment, especially a shirt, except for the attachment of sleeves and rounding or finishing of the neck for the shirt. It is to the provision of such a process and product to which the present invention is primarily directed. When the full-fashioned weaving process of the present invention is employed, the additional step required for a two-dimensional fabric of sewing side seams is avoided.

SUMMARY OF THE INVENTION

It is, therefore, an object of the present invention to provide a process to produce a full-fashioned woven garment comprised of only a single integrated piece and in which there are no discontinuities or seams.

It is a further object of the invention to be able to fashion a garment which can accommodate holes, such as armholes, for example, a shirt, without requiring cutting and sewing of the fabric, except for the attachment of sleeves and rounding or finishing of the neck, if such is desired.

It is yet a further object of the present invention to be able to provide a full-fashioned garment for sensate care which can include intelligence capability, such as the ability to monitor one or more body physical signs and/or penetration of the garment, and a process for making such a garment.

In the full-fashioned woven garment of the present invention, two different weave structures are used: one is a tubular structure section and the other is a double layer structure section of the fabric. Unlike the structure of a regular shirt made of woven fabric where the front and back need to be sewn together to make a "one-piece" garment, the tubular structure fabric of the present invention emerges as an integrated "one piece" garment during the weaving process. In the tubular section of the woven fabric, only one thread or set of threads is interlaced helically and continuously on the front and back.

In the drawing-in-draft for the tubular structure section of the woven fabric of the present invention, two different sets of warp threads are used alternately—one is for the front and the other is for the back of the fabric. The lifting plan provides the sequence of harness movements. The harnesses of the loom are lifted by the lifting plan representing the front and back of the fabric alternately. Since this is a double cloth structure, both the front and back warp threads are placed in the same dent of the reed of the loom.

Although the filling for a tubular fabric needs only one set of continuous threads, the full-fashioned woven garment of the present invention, when accommodating holes, such as armholes, requires two sets of threads. This is because of the innovative nature of the double layer structure section of the garment.

One innovative facet of our full-fashioned woven garment lies in the creation of a hole in the fabric, such as an armhole, by way of the double layer structure section of the garment. Unlike the tubular structure section, in the double layer structure section of the garment, there are two sets of threads, and a double-layer structure is used separately for the front and back of the garment. Since two sets of threads are used from the tubular structure section, the fabric of the double layer structure section can be woven continuously from the tubular structure section. Likewise, the tubular structure section can be woven continuously from the double layer structure section. In this manner, for example, a full-fashioned woven garment may be made by continuously weaving a first tubular structure section as described, followed by a double layer structure section woven from the tubular structure section, and then a second tubular structure section from the double layer structure section. Other combinations of continuously woven tubular structure and double layer structure sections may also be made. Further, the full-fashioned weaving process of the present invention is not limited to the manufacture of a garment having armholes, but is generally applicable to the manufacture of any full-fashioned garment which may require similar holes.

In one particular embodiment, to accomplish such a woven garment employing, for example, a 24 harness loom, the lifting plan for the double layer structure is more complicated than the plan for the first and second tubular structure sections of the garment because of the number of harnesses used (fewer harnesses are used for the tubular structure sections than for the double layer structure section). The loom's 24 harnesses are divided into six sets. Each set contains four harnesses. Among the four harnesses in each set, two harnesses are used for the front layer and the other two are used for the back layer of the garment. As described in more detail below, to make an armhole for the garment, the width of each drawing set is sequentially increased a desired amount and then sequentially decreased the same amount on both layers, and each set of harnesses is dropped in every 1 inch length of fabric and subsequently picked up in a similar manner. Since the sequence of drawing-in for both sides of the garment is the same, the armhole will be created simultaneously on both sides of the double layer structure section. In this manner, a single continuous woven garment is thereby produced in which armholes are created.

In a flyer embodiment, the woven garment made in accordance with the present invention may be fashioned into a garment for sensate care ("sensate liner"). The sensate liner can be provided with means for monitoring one or more body vital signs, such as blood pressure, heart rate, pulse and temperature, as well as for monitoring liner penetration. The sensate liner consists of: a base fabric ("comfort component"), and at least one sensing component. The sensing component can be either a penetration sensing material component, or an electrical conductive material component, or both. The preferred penetration sensing component is plastic optical fiber. The preferred electrical conductive component is either a doped inorganic fiber with polyethylene, nylon or other insulating sheath, or a thin gauge copper wire with polyethylene sheath. Optionally, the liner can include a form-fitting component, such as Spandex fiber, or a static dissipating component, such as Nega-Stat, depending upon need and application. Each of these components can be incorporated into the full-fashioned weaving process of the present invention and thereby incorporated into a full-fashioned sensate liner.

It can be seen from the description herein of our invention that a full-fashioned weaving process is provided, by which a full-fashioned woven garment can be made, which accommodates discontinuities in the garment, such as armholes, without requiring cutting and sewing, and by which a sensate garment can be made. These and other objects and advantages of the present invention will become apparent upon reading the following specification and claims in conjunction with the accompanying drawing figures.

DETAILED DESCRIPTION OF THE ILLUSTRATIVE EMBODIMENTS

Figure 1:
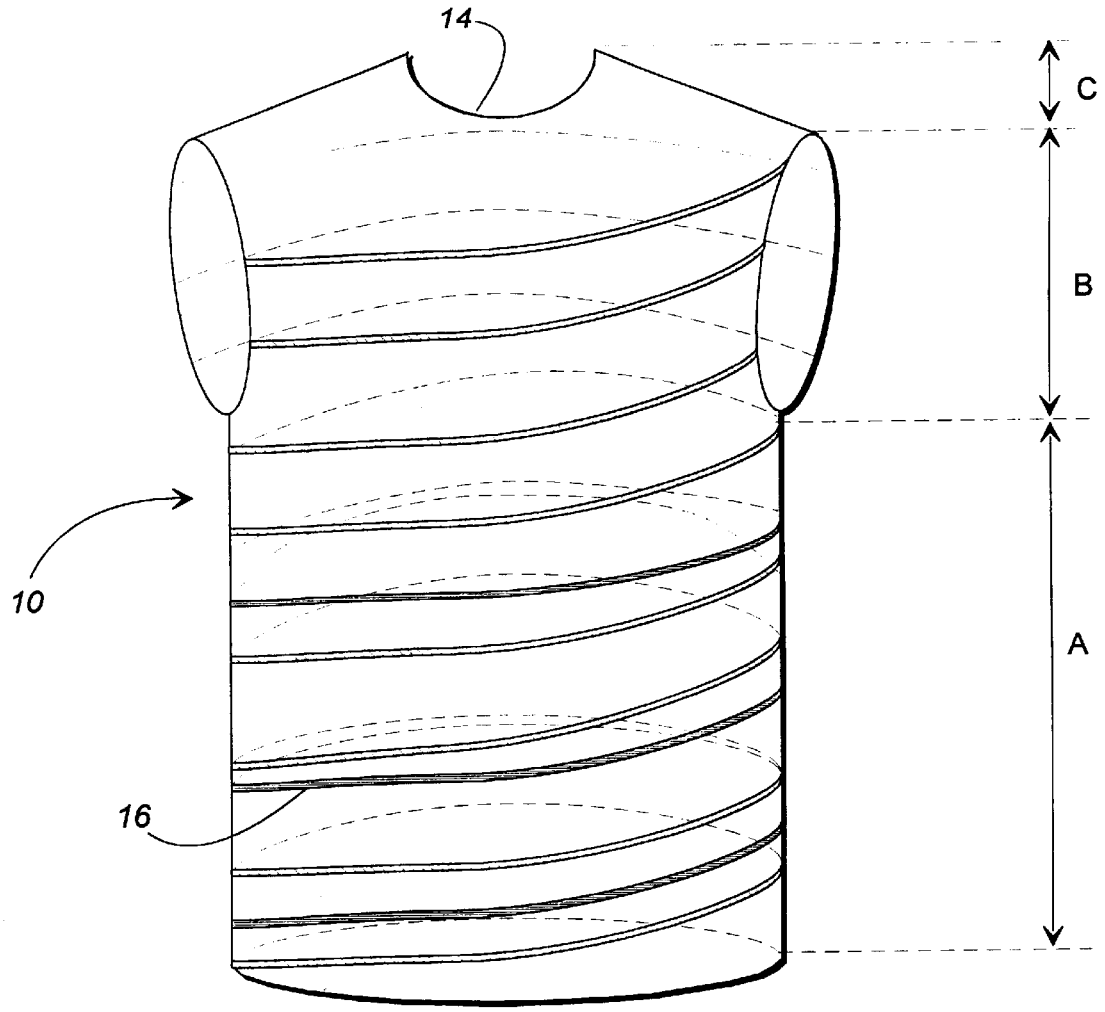
FIG. 1 is a front elevational view of a full-fashioned woven garment made from the full-fashioned weaving process of the present invention.

Referring now to the above figures, wherein like reference numerals represent like parts throughout the several views, the full-fashioned weaving process and product of the present invention will be described in detail.

A. The Full-Fashioned Weaving Process and Garment of the Present Invention

As illustrated in FIG. 1, in a full-fashioned woven garment 10 made in accordance with the present invention, two different weave structures are used: one is the tubular structure for Sections A and C and the other is the double layer structure for Section B. To assist in the description of the present invention, reference will now be made to a garment, such as a sleeveless shirt having a rounded neck 14 similar to a knitted T-shirt, fashioned by the fully-fashioned weaving process of the present invention. However, it should be recognized that the present invention is not limited to only such a garment.

1. Description of Sections A and C of the Garment

Unlike the structure of a regular shirt made of woven fabric where the front and back need to be sewn together to make a "one-piece" garment, the structure of the present invention emerges as an integrated "one piece" garment during our full-fashioned weaving process. Only one thread or set of threads 16 is interlaced helically and continuously on the front and back for making the tubular section of the fabric (garment).

Figure 2:
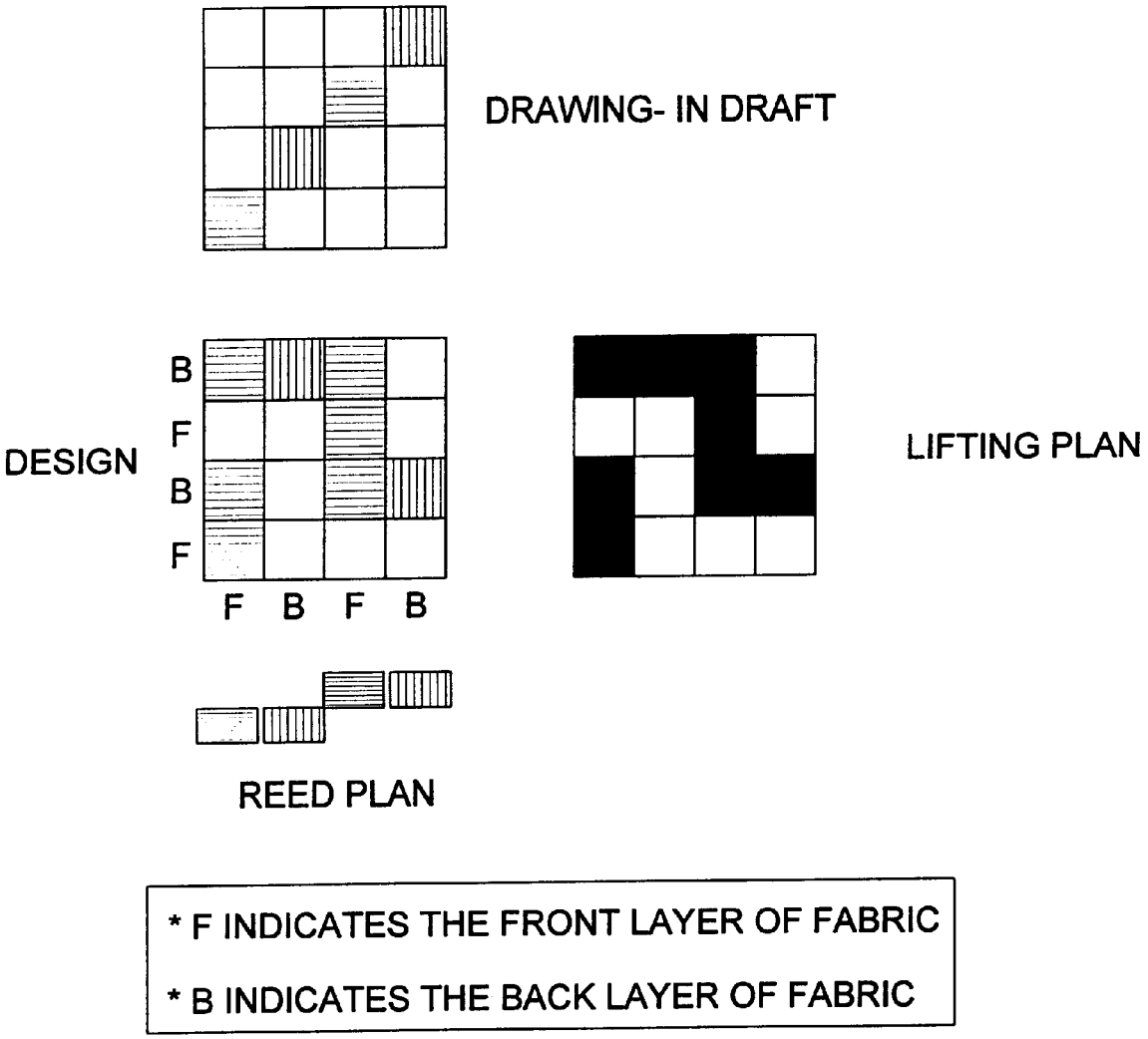
FIG. 2 illustrates the drawing-in-draft, lifting plan, reed plan and design of the tubular weave structure sections of the garment of FIG. 1.

FIG. 2 shows one unit of drawing-in draft, lifting plan and reed plan as well as the design for the tubular structure sections A and C of the garment. The drawing-in draft indicates the pattern in which the warp ends are arranged in their distribution over the harness frames. In the drawing-in draft, two different sets of threads are used alternately—one is for the front F and the other is for the back B of the garment. The lifting plan defines the selection of harnesses to be raised or lowered on each successive insertion of the pick or filling. The harnesses of the loom are lifted by the lifting plan representing the front and back of the garment alternately. Since this is the double cloth structure, both the front and back warp threads are placed in the same dent of the reed of the loom. The reed plan shows the arrangement of the warp ends in the reed dents for the front and back of the garment.

Although the filling for a tubular fabric needs only one set of continuous threads, in one embodiment the full-fashioned woven garment of the present invention makes use of two sets of threads. This is because of the innovative nature of Section B.

2. Description of Section B of the Garment

One innovative facet of our full-fashioned weaving process lies in the creation of the armhole of the tubular woven fabric. Section B is the place for the armhole. Unlike tubular structure Sections A and C, in the double layer structure Section B, there are two sets of threads, and a double-layer structure is used separately for the front F and back B of the garment. Since two sets of threads are used from the previous tubular structure section (Section A), the fabric of Section B can be woven continuously from the fabric of Section A. Furthermore, it will be integrated with Section C.

Tubular weaving is a special variation of traditional weaving in which a fabric tube is produced on the loom. This technology has been chosen over traditional weaving for producing our full-fashioned woven garment because cutting and sewing of the fabric will be obviated (with the exception, for example, of rounding or finishing the neck required for fashioning a shirt at the present time), and the resulting structure will be similar to a regular sleeveless undershirt, i.e., without any seams at the sides. It should be understood by those skilled in the art that the garment may be her fashioned by attaching sleeves or adding a collar or both.

A loom that permits the production of such a woven garment is the AVL Compu-Dobby, a shuttle loom that can be operated both in manual and automatic modes. It can also be interfaced with computers so that designs created using design software can be downloaded directly into the shed control mechanism. Alternatively, a jacquard loom may also be used. Since a dobby loom has been used, the production of the woven fabric on such a loom will be described. The loom configuration for producing the woven garment is:

| Parameter | Details |
|---|---|
| Loom Model | AVL Industrial Dobby Loom |
| Loom Description | Computer Controlled Dobby |
| Width | 60 Inches |
| Number of Harnesses | 24 |
| Dents/Inch | 10 |
| Take-Up Mechanism | Automatic Cloth Storage System |

The following steps have been followed for producing a woven garment in accordance with our present invention.

1. Enter the weave pattern in the design software and download it into the AVL Compu-Dobby.
2. Prepare 160 Pirns for 2-inch spacing sectional warp beam.
3. Warp yarns onto sectional warp beam 22-inches wide.
4. Install the required number of drop wires.
5. Draw-in 1600 ends through the drop wires.
6. Draw-in 1600 ends through the heddles of 24 harnesses with specific sequences based on the defined weave pattern.
7. Draw 1600 ends through the reed.
8. Tie ends onto weaver's beam on each end.
9. Prepare 8 bobbins for filling with 6 shuttles.

Figure 3:
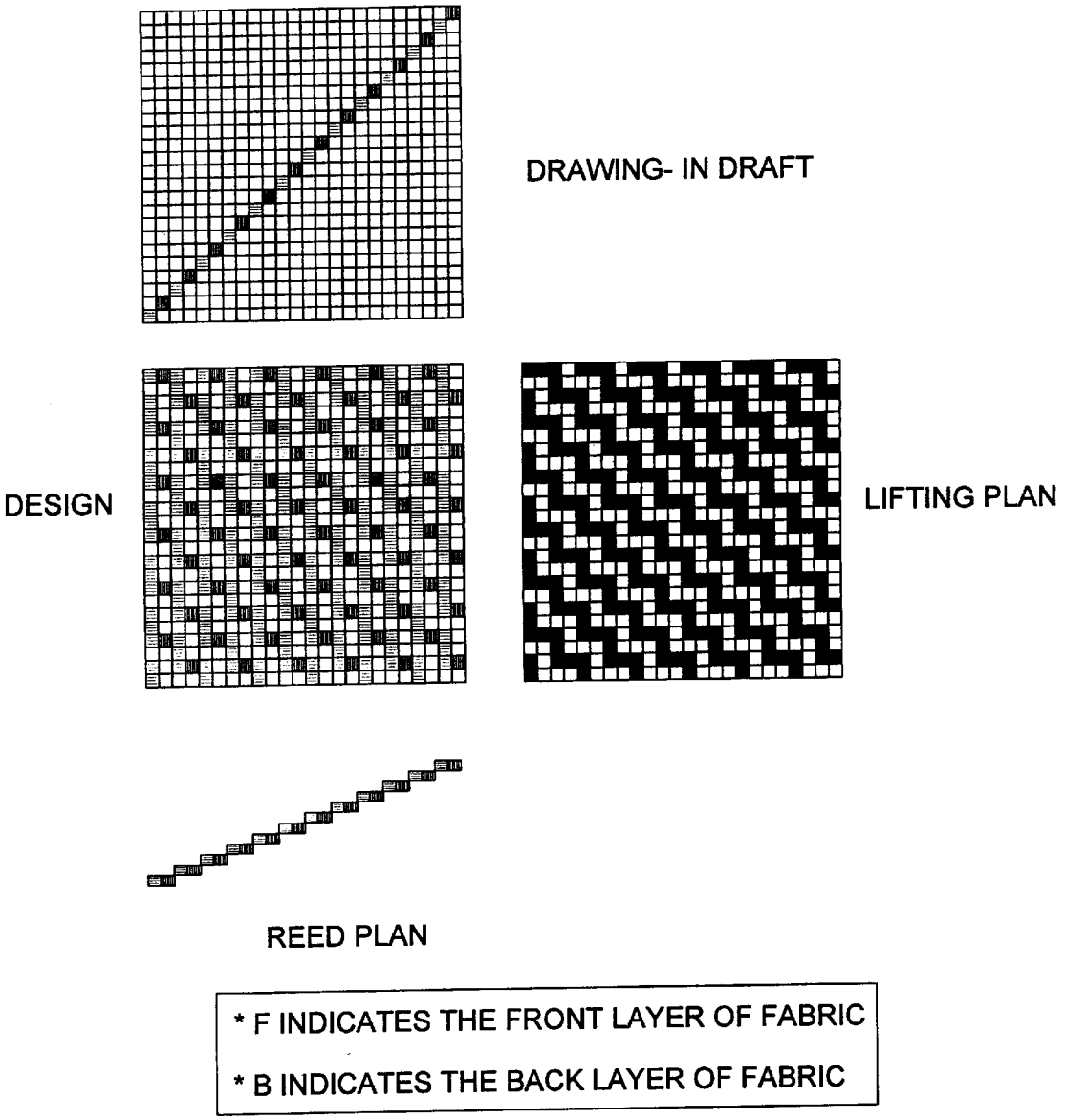
FIG. 3 illustrates the drawing-in-draft, lifting plan, reed plan and design of the double layer weave structure section of the garment of FIG. 1.

In FIG. 3, the drawing-in draft, lifting plan, and reed plan (as defined above in reference to FIG. 2) and the design for the twenty four (24) harnesses of the loom used for the double layer structure section of the garment are illustrated. To accomplish a continuous woven garment, the lifting plan of the double layer structure Section B is more complicated than the plan for the tubular structure Sections A and C because of the number of harnesses used (only four harnesses are used for Sections A and C as shown in FIG. 2). However, the reed plan is the same for Section B as the other Sections A and C.

Figure 4:
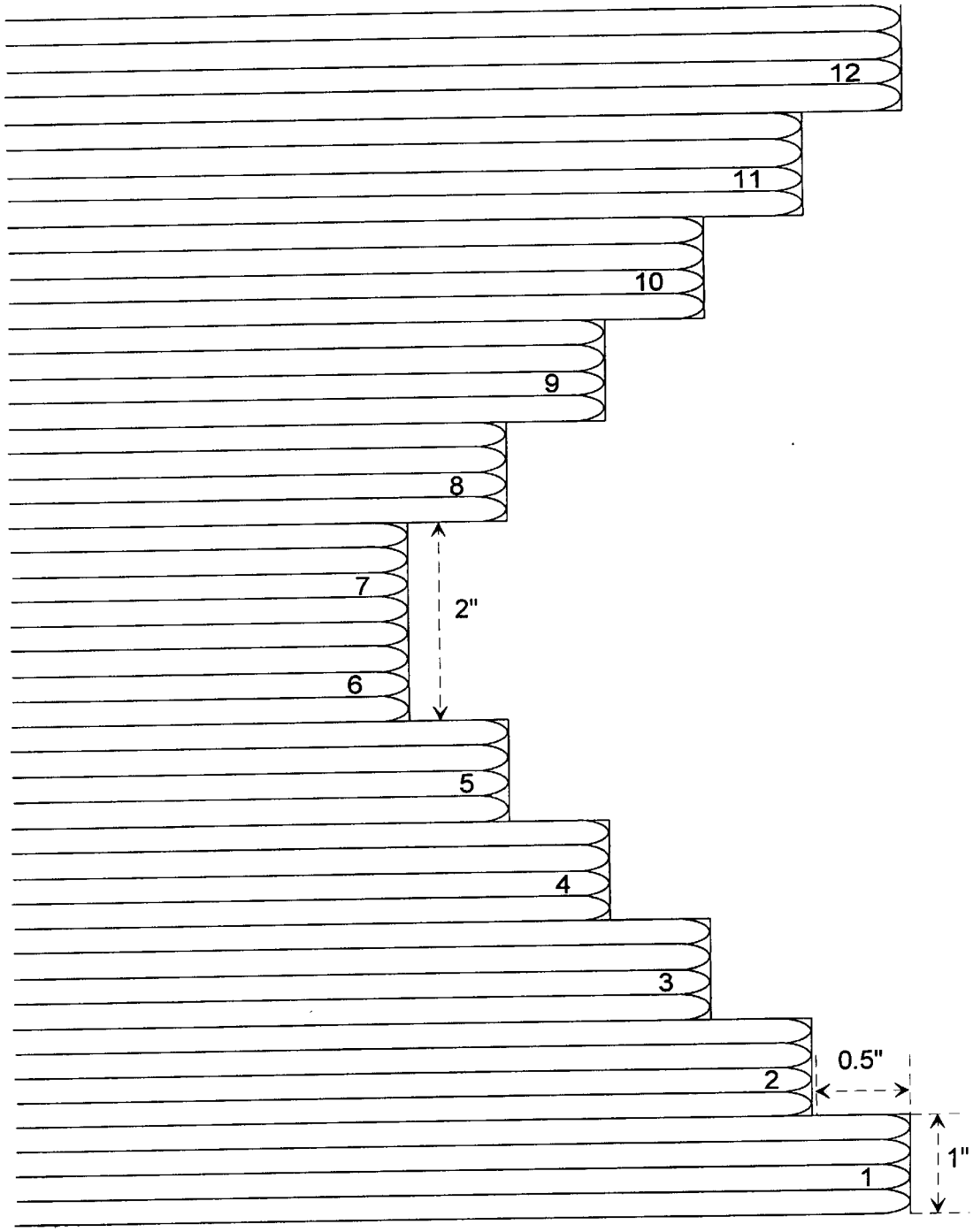
FIG. 4 illustrates one embodiment of the woven armhole portion of the double layer weave structure section of the garment of FIG. 1.

The 24 harnesses of the loom are divided into six sets. Each set contains four harnesses. Among the four harnesses in each set, two harnesses are used for the front layer and the other two are used for the back layer of the garment. As illustrated in FIG. 4, to make an armhole for the garment, the width of each drawing set is sequentially increased and then decreased 0.5 inches on both sides, and each set of harnesses is dropped in every 1 inch length of fabric and subsequently picked up in a similar manner. The dropping sequence of the harness sets is 1, 2, 3, 4, 5 and 6 for one half of the armhole in FIG. 4. Moreover, the harness sets need to be used for the other half of the armhole. The sequence for the harness sets for closing the armhole will be 7, 8, 9, 10, 11 and 12 in FIG. 4. Since the sequence of drawing-in for both sides of the garment is the same, the armhole will be created simultaneously on both sides of the double layer structure Section B.

It will be apparent to one skilled in the art that production of the woven garment in accordance with our present invention is not limited to using a weaving loom having 24 harnesses. A smoother armhole can be made by using a 48 harness loom. Likewise, use of a 400 hook jacquard loom machine will provide yet a smoother armhole in Section B.

The woven garment may be made of any yarn applicable to conventional woven fabrics. The choice of material for the yarn will ordinarily be determined by the end use of the fabric and will be based on a review of the comfort, fit, fabric hand, air permeability, moisture absorption and structural characteristics of the yarn. Suitable yams include, but are not limited to, cotton, polyester/cotton blends, microdenier polyester/cotton blends and polypropylene fibers such as Meraklon (made by Dawtex Industries).

B. A Sensate Liner in Accordance With the Present Invention

In addition to the advantage of obviating cutting and sewing, the woven garment and process of the present invention may provide the basis for a garment for sensate care ("sensate liner"). Such a liner can be provided with means for monitoring body physical signs, such as blood pressure, heart rate, pulse and temperature, as well as for monitoring liner penetration. The sensate liner consists of the following components: the base of the fabric or "comfort component," and one or more sensing components. Additionally, a form-fitting component and a static dissipating component may be included, if desired.

Figure 5:
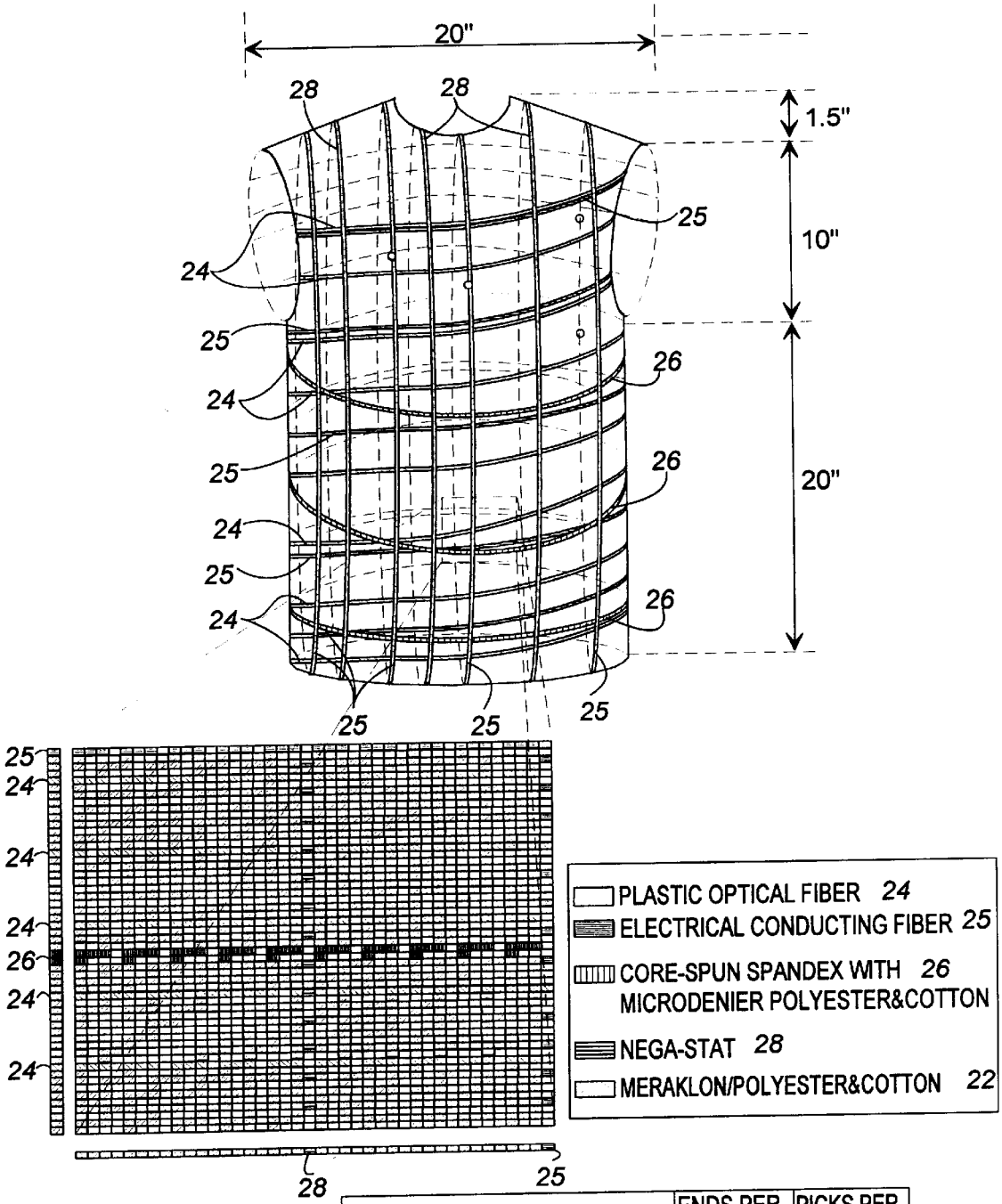
FIG. 5 illustrates a further embodiment of the present invention in the form of a sensate liner.

FIG. 5 shows one representative design of the sensate liner 20 of the present invention. It consists of a single-piece garment woven and fashioned as described above and is similar to a regular sleeveless T-shirt. The legend in the figure denotes the relative distribution of yarns for the various structural components of the liner in a 2" segment.

The comfort component 22 is the base of the fabric. The comfort component will ordinarily be in immediate contact with the wearer's skin and will provide the necessary comfort properties for the liner/garment. Therefore, the chosen material should provide at least the same level of comfort and fit as compared to a typical undershirt, e.g., good fabric hand, air permeability, moisture absorption and stretchability.

The comfort component can consist of any yarn applicable to conventional woven fabrics. The choice of material for the yarn will ordinarily be determined by the end use of the fabric and will be based on a review of the comfort, fit, fabric hand, air permeability, moisture absorption and structural characteristics of the yarn. Suitable yarns include, but are not limited to, cotton, polyester/cotton blends, microdenier polyester/cotton blends and polypropylene fibers such as Meraklon (made by Dawtex Industries).

The major fibers particularly suitable for use in the comfort component are Meraklon, and polyester/cotton blend. Meraklon is a polypropylene fiber modified to overcome some of the drawbacks associated with pure polypropylene fibers. Its key characteristics in light of the performance requirements are: (a) good wickability and comfort; (b) bulk without weight; (c) quick drying; (d) good mechanical and color fastness properties; (e) non-allergenic and antibacterial characteristics; and (f) odor-free with protection against bacterial growth. Microdenier polyester/cotton blends are extremely versatile fibers and are characterized by: (a) good feel, i.e., handle; (b) good moisture absorption; (c) good mechanical properties and abrasion resistance; and (d) ease of processing. It should be recognized that other fibers meeting such performance requirements are also suitable. Microdenier polyester/cotton blended fibers are available from Hamby Textile Research of North Carolina. Microdenier fibers for use in the blend are available from DuPont. Meraklon yarn is available from Dawtex, Inc., Toronto, Canada. In FIG. 5, Meraklon is shown in both the warp and fill directions of the fabric.

The sensing component of the sensate liner can include materials for sensing penetration of the liner 24, or one or more body physical signs 25, or both. These materials are woven during the weaving of the comfort component of the liner. After fashioning of the liner is completed, these materials can be connected to a monitor (referred to as a "personal status monitor" or "PSM") which will take readings from the sensing materials, monitor the readings and issue an alert depending upon the readings and desired settings for the monitor, as described in more detail below.

Materials suitable for providing penetration sensing and alert include: silica-based optical fibers, plastic optical fibers, and silicone rubber optical fibers. Suitable optical fibers include those having a filler medium which have a bandwidth which can support the desired signal to be transmitted and required data streams. Silica-based optical fibers have been designed for use in high bandwidth, long distance applications. Their extremely small silica core and low numerical aperture (NA) provide a large bandwidth (up to 500 mhz*km) and low attention (as low as 0.5 dB/km). However, such fibers are not preferred because of high labor costs of installation and the danger of splintering of the fibers.

Plastic optical fibers (POF) provide many of the same advantages that glass fibers do, but at a lower weight and cost. In certain fiber applications, as in some sensors and medical applications, the fiber length used is so short (less than a few meters) that the fiber loss and fiber dispersion are of no concern. Instead, good optical transparency, adequate mechanical strength, and flexibility are the required properties and plastic or polymer fibers are preferred. Moreover, plastic optical fibers do not splinter like glass fibers and, thus, can be more safely used in the liner than glass fibers.

For relatively short lengths, POFs have several inherent advantages over glass fibers. POFs exhibit relatively higher numerical aperture (NA), which contributes to their capability to deliver more power. In addition, the higher NA lowers the POF's susceptibility to light loss caused by bending and flexing of the fiber. Transmission in the visible wavelengths range is relatively higher than anywhere else in the spectra. This is an advantage since in most medical sensors the transducers are actuated by wavelengths in the visible range of the optical spectra. Because of the nature of its optical transmission, POF offers similar high bandwidth capability and the same electromagnetic immunity as glass fiber. In addition to being relatively inexpensive, POF can be terminated using a hot plate procedure which melts back the excess fiber to an optical quality end finish. This simple termination combined with the snap-lock design of the POF connection system, which connection system can be a conventional connection system, allows for the termination of a node in under a minute. This translates into extremely low installation costs. Further, POFs can withstand a rougher mechanical treatment displayed in relatively unfriendly environments. Applications demanding inexpensive and durable optical fibers for conducting visible wavelengths over short distances are currently dominated by POFs made of either poly-methyl-methacrylate (PMMA) or styrene-based polymers.

Silicone rubber optical fibers (SROF), a third class of optical fibers, provide excellent bending properties and elastic recovery. However, they are relatively thick (of the order of 5 mm) and suffer from a high degree of signal attenuation. Also, they are affected by high humidity and are not yet commercially available. Hence, although these fibers are not preferred for use in the sensate liner, they can be used. Those fibers can be obtained from Oak Ridge National Lab, Oak Ridge, Tenn.

In FIG. 5, the POF 24 is shown in the filling direction of the fabric, though it need not be limited to only the filling direction. To incorporate the penetration sensing component material into the woven fabric, the material, preferably plastic optical fiber (POF), is spirally integrated into the structure during the full-fashioned weaving fabric production process. The POF does not terminate under the armhole. Due to the above described modification in the weaving process, the POF continues throughout the fabric without any discontinuities. This results in only one single integrated fabric and no seams insofar as the POF is concerned. The preferred plastic optical fiber is from Toray Industries, New York, in particular product code PGU-CD-501-10-E optical fiber cord. Another POF that can be used is product code PGS-GB 250 optical fiber cord from Toray Industries.

Alternatively, or additionally, the sensing component may consist of an electrical conducting material component (ECC) 25. The electrical conductive fiber preferably has a resistivity of from about $0.07\times10^{-3}$ to 10 Kohms/cm. The ECC 25 can be used to monitor one or more body vital signs including heart rate, pulse rate, temperature and blood pressure through sensors on the body and for linking to a personal status monitor (PSM). Suitable materials include the three classes of intrinsically conducting polymers, doped inorganic fibers and metallic fibers, respectively.

Polymers that conduct electric currents without the addition of conductive (inorganic) substances are known as "intrinsically conductive polymers" (ICP). Electrically conducting polymers have a conjugated structure, i.e., alternating single and double bonds between the carbon atoms of the main chain. In the late 1970's, it was discovered that polyacetylene could be prepared in a form with a high electrical conductivity, and that the conductivity could be further increased by chemical oxidation. Thereafter, many other polymers with a conjugated (alternating single and double bonds) carbon main chain have shown the same behavior., e.g., polythiophene and polypyrrole. In the beginning, it was believed that the processability of traditional polymers and the discovered electrical conductivity could be combined. However, it has been found that the conductive polymers are rather unstable in air, have poor mechanical properties and cannot be easily processed. Also, all intrinsically conductive polymers are insoluble in any solvent and they possess no melting point or other softening behavior. Consequently, they cannot be processed in the same way as normal thermoplastic polymers and are usually processed using a variety of dispersion methods. Because of these shortcomings, fibers made up of fully conducting polymers with good mechanical properties are not yet commercially available and hence are not presently preferred for use in the sensate liner, though they can be used in the liner.

Yet another class of conducting fibers consists of those that are doped with inorganic or metallic particles. The conductivity of these fibers is quite high if they are sufficiently doped with metal particles, but this would make the fibers less flexible. Such fibers can be used to carry information from the sensors to the monitoring unit if they are properly insulated.

Metallic fibers, such as copper and stainless steel insulated with polyethylene or polyvinyl chloride, can also be used as the conducting fibers in the liner. With their exceptional current carrying capacity, copper and stainless steel are more efficient than any doped polymeric fibers. Also, metallic fibers are strong and they resist stretching, neck-down, creep, nicks and breaks very well. Therefore, metallic fibers of very small diameter (of the order of 0.1 mm) will be sufficient to carry information from the sensors to the monitoring unit. Even with insulation, the fiber diameter will be less that 0.3 mm and hence these fibers will be very flexible and can be easily incorporated into the liner. Also, the installation and connection of metallic fibers to the PSM unit will be simple and there will be no need for special connectors, tools, compounds and procedures.

One example of a high conductive yarn suitable for this purpose is Bekinox available from Bekaert Corporation, Marietta, Ga., a subsidiary of Bekintex NV, Wetteren, Belgium, which is made up of stainless steel fibers and has a resistivity of 60 ohm-meter. The bending rigidity of this yarn is comparable to that of the polyamide high-resistance yarns and can be easily incorporated into the data bus in our present invention.

Thus, the preferred electrical conducting material for the sensing component for the sensate liner are: (i) doped inorganic fibers with polyethylene, nylon or other insulating sheath; (ii) insulated stainless steel fibers; and (iii) thin copper wires with polyethylene sheath. All of these fibers can readily be incorporated into the liner and can serve as elements of an elastic printed circuit board, described below. An example of an available doped inorganic fiber is X-Static coated nylon (T66) from Sauquoit Industries, South Carolina. An example of an available thin copper wire is 24 gauge insulated copper wire from Ack Electronics, Atlanta, Ga.

The electrical conducting component fibers 25 can be incorporated into the woven fabric in two ways: (a) regularly spaced yarns acting as sensing elements; and (b) precisely positioned yams for carrying signals from the sensors to the PSM. They can be distributed both in the warp and filling directions in the woven fabric.

The form-fitting component (FFC) 26 provides form-fit to the wearer, if desired. More importantly, it keeps the sensors in place on the wearer's body during movement. Therefore, the material chosen should have a high degree of stretch to provide the required form-fit and at the same time, be compatible with the material chosen for the other components of the sensate liner. Any fiber meeting these requirements is suitable. The preferred form-fitting component is Spandex fiber, a block polymer with urethane groups. Its elongation at break ranges from 500 to 600% and, thus, can provide the necessary form-fit to the liner. Its elastic recovery is also extremely high (99% recovery from 2–5% stretch) and its strength is in the 0.6–0.9 grams/denier range. It is resistant to chemicals and withstands repeated machine washings and the action of perspiration. It is available in a range of linear densities.

The Spandex band 26 shown in the filling direction in FIG. 5 is the FFC for the tubular woven fabric providing the desired form-fit. These bands behave like "straps", but are unobtrusive and are well integrated into the fabric. There is no need for the wearer to tie something to ensure a good fit for the garment. Moreover, the Spandex band will expand and contract as the wearer's chest expands and contracts during normal breathing. The Spandex fibers can be obtained from E.I. du Pont de Nemours, Wilmington, Del.

The purpose of the static dissipating component (SDC) 28 is to quickly dissipate any built-up static charge during the usage of the sensate liner. Such a component may not always be necessary. However, under certain conditions, several thousand volts may be generated which could damage the sensitive electronic components in the PSM Unit. Therefore, the material chosen must provide adequate electrostatic discharge protection (ESD) protection in the liner.

Nega-Stat, a bicomponent fiber produced by DuPont is the preferred material for the static dissipating component (SDC). It has a trilobal shaped conductive core that is sheathed by either polyester or nylon. This unique trilobal conductive core neutralizes the surface charge on the base material by induction and dissipates the charge by air ionization and conduction. The nonconductive polyester or nylon surface of Nega-Stat fiber controls the release of surface charges from the thread to provide effective static control of material in the grounded or ungrounded applications according to specific end-use requirements. The outer shell of polyester or nylon ensures effective wear-life performance with high wash and wear durability and protection against acid and radiation. Other materials which can effectively dissipate static and yet function as a component of a wearable, washable garment may also be used.

Referring again to FIG. 5, the Nega-Stat fiber 28 running along the height of the shirt, in the warp direction of the fabric, is the static dissipating component (SDC). The proposed spacing is adequate for the desired degree of static discharge. For the woven tubular garment, it will ordinarily, but not necessarily, be introduced in the warp direction of the fabric.

Figure 6:
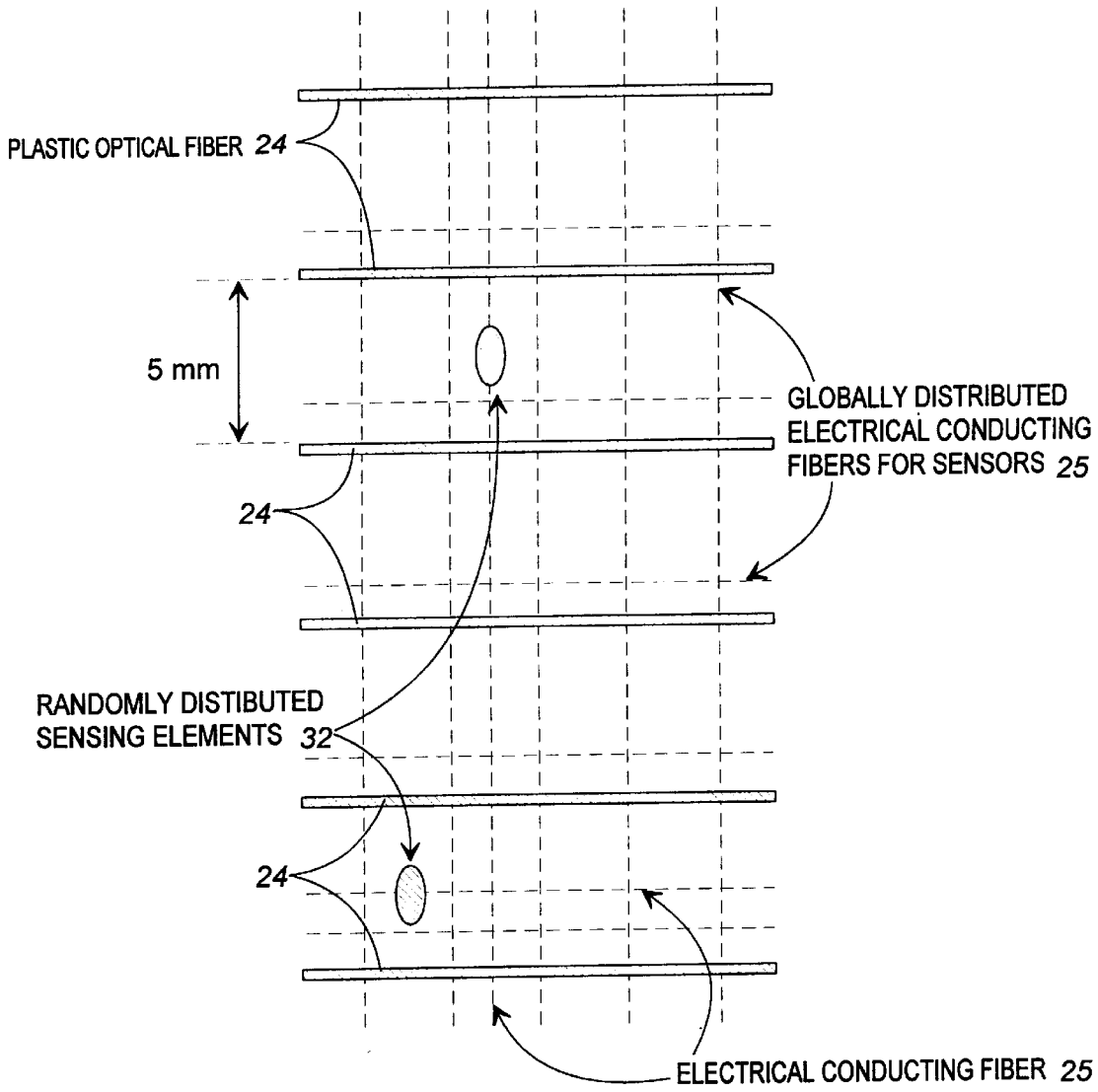
FIG. 6 illustrates the sensor interconnection for the sensate liner of FIG. 5.
Figure 9:
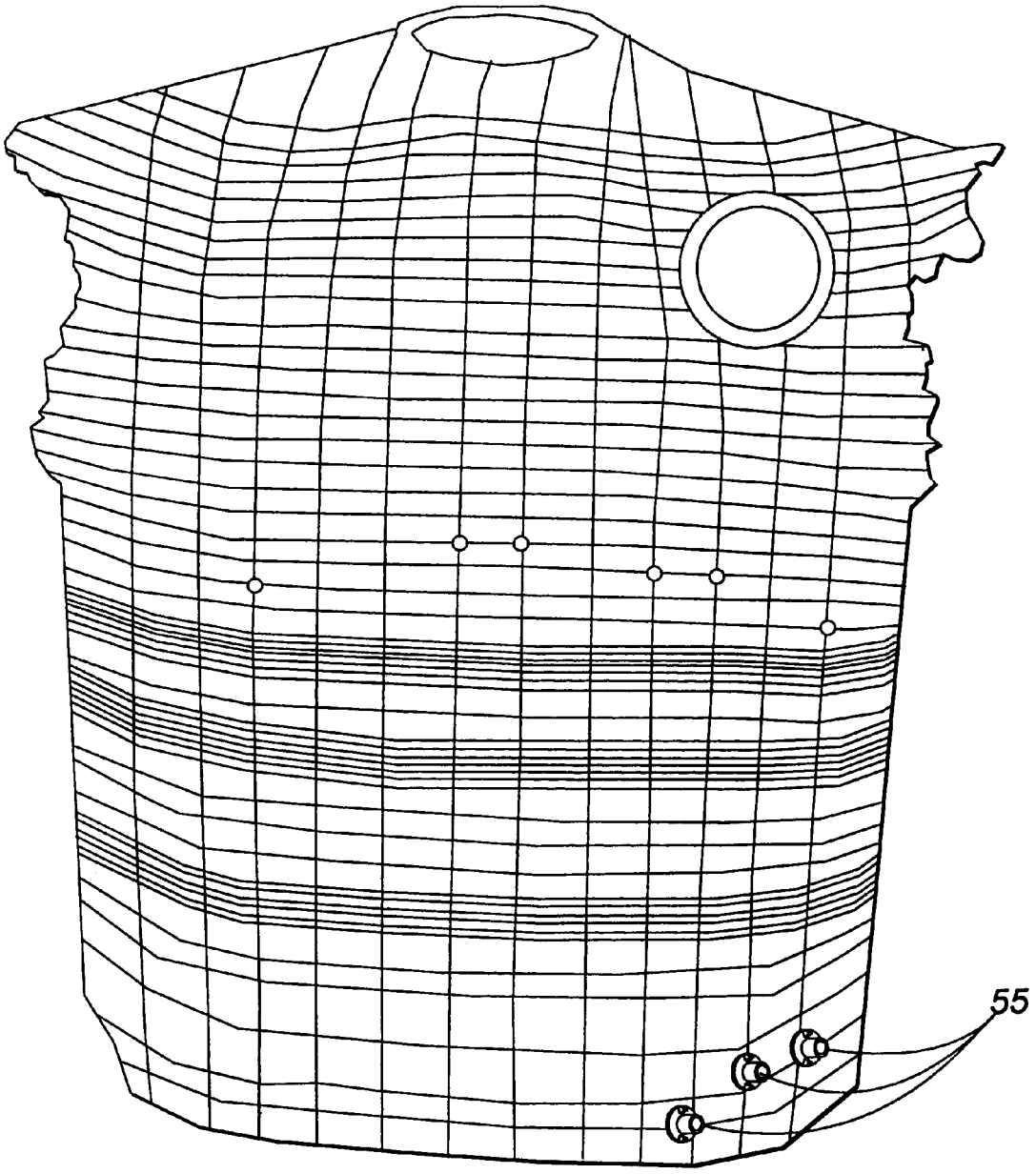
FIG. 9 illustrates a full-fashioned garment with T-connectors for sensors.

With reference to FIG. 6, connectors (shown in FIG. 9 as element 55), such as T-connectors (similar to the "button clips" used in clothing), can be used to connect the body sensors 32 to the conducting wires that go to the PSM. By modularizing the design of the sensate liner (using these connectors), the sensors themselves can be made independent of the liner. This accommodates different body shapes. The connector makes it relatively easy to attach the sensors to the wires. Yet another advantage of separating the sensors themselves from the liner, is that they need not be subjected to laundering when the liner is laundered, thereby minimizing any damage to them. However, it should be recognized that the sensors 32 can also be woven into the structure.

The specification for the preferred materials to be used in the production of our senate liner are as follows:

| Component | Materials | Count (CC) |
|---|---|---|
| Penetration Sensing (PSC) | Plastic Optical Fibers (POF) | 6s Ne<br>Core-Spun from 12s Ne POF/sheathed from 12s<br>Ne POF |
| Comfort (CC) | Meraklon Microdenier Poly/Cotton Blend | 8s NE |
| Form-fitting (FFC) | Spandex | 8s Ne Core-Spun from 12s<br>NE Spandex yarn |
| Global and Random Conducting (ECC) | Copper with polyethylene sheath, Doped inorganic fiber with sheath | 6s Ne |
| Static Dissipating (SDC) | Nega-Stat | 18s Ne |

The above yarn counts have been chosen based on initial experimentation using yarn sizes that are typically used in undergarments. Other yarn counts can be used. FIG. 5 also shows the specifications for the tubular woven fabric. The weight of the fabric is around 10 oz/yd$^2$ or less. While the above materials are the preferred materials for use in the production of our sensate liner, upon reading this specification it will be readily recognized that other materials may be used in place of these preferred materials and still provide a garment for sensate care in accordance with our present invention.

C. Core Spinning Technology

Core spinning is the process of sheathing a core yarn (e.g., POF or conducting yarns) with sheath fibers (e.g., Meraklon or Polyester/Cotton). It is not required in all situations for the present invention. It is desirable when the sensing components, or other components other than the comfort component, do not possess the comfort properties that are desired for the woven garment. There are two ways to core spin yarns—one using modified ring spinning machines and another by using a friction spinning machine. Ring spinning machines are very versatile and can be used for core spinning both fine and coarse count yarns. However, the productivity of the ring spinning machine is low and the package sizes are very small. Friction spinning machines can be used only to produce coarse count yarns, but the production rates and the package sizes are much higher than ring spinning. Where the yams that are used are relatively coarse, friction spinning technology is preferred for core spinning the yarns.

The preferred configuration of the friction spinning machine for producing core spun yarns is as follows:

| Parameter | Details |
|---|---|
| Machine Model | DREF3 ® |
| Machine Description | Friction Core Spinning Machine |
| Draft | 200 |
| Speed | 170 m/min |
| Number of Doublings | 5 |
| Drafting Mechanism Type | 3/3 |
| Core-Sheath Ratio | 50:50 |

Approximately 2000 m of core spun yarns were produced on a friction spinning machine. POF was used as the core and Polyester/Cotton as the sheath. A core/sheath ratio of 50:50 was chosen so that the yarn had optimum strength and comfort properties.

Figure 7:
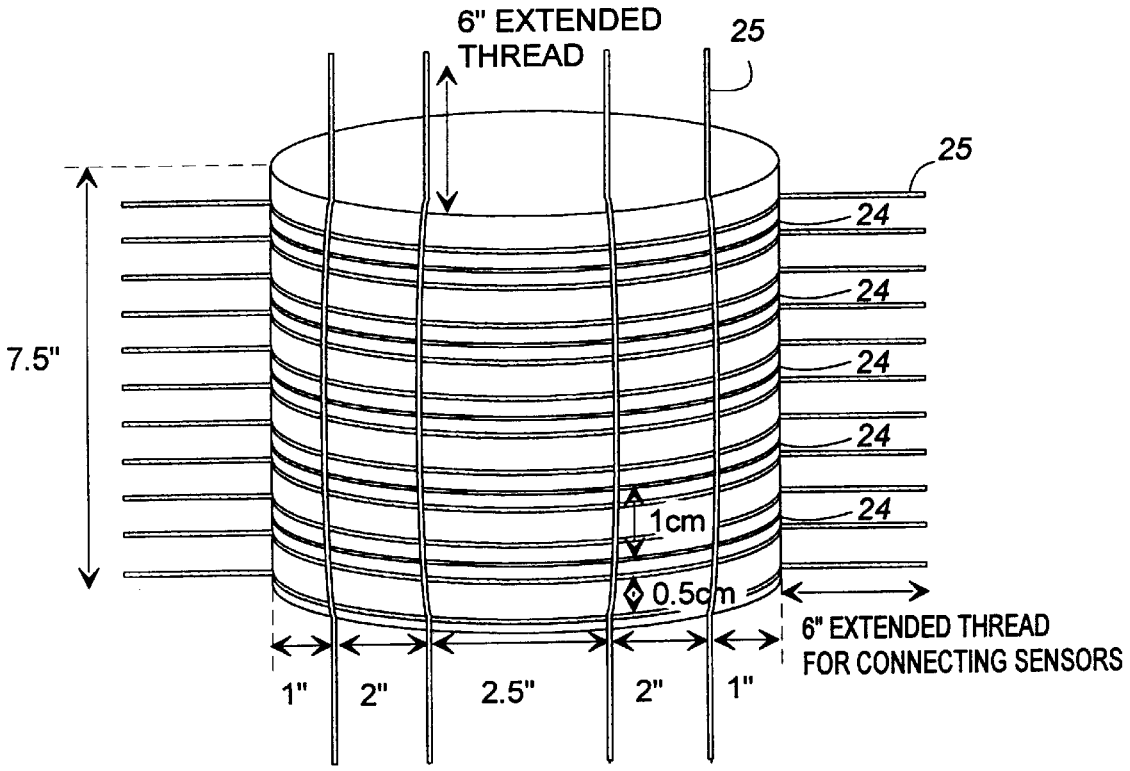
FIG. 7 illustrates a woven sample of the liner of FIG. 5.
Figure 8:
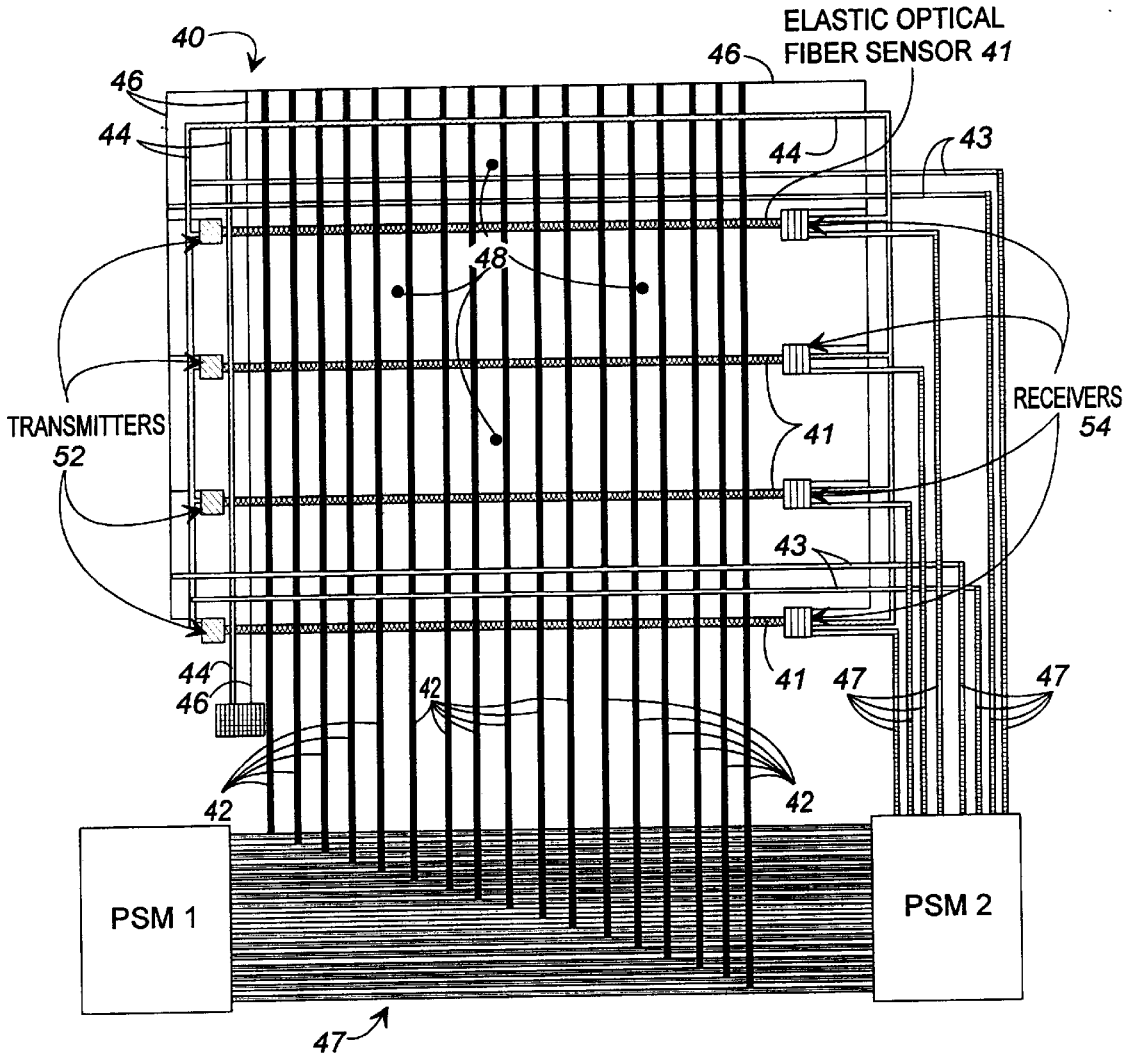
FIG. 8 illustrates the invention of FIG. 5 in the form of a printed elastic board.

A full scale prototype was produced on the AVL-Dobby loom. Additionally, two samples of the woven sensate liner were produced on a tabletop loom. The specifications for the samples are shown in FIG. 7. These samples were designed with low 42 and high 43 conductive electrical fibers spaced at regular intervals to act as an elastic circuit board 40. The circuit diagram of this board is illustrated in FIG. 8. The figure shows the interconnections between the power 44 and ground 46 wires and low 42 and high 43 conducting fibers. The data bus 47 for transferring data from the randomly positioned interconnection points 48 for the sensors to Personal Status Monitors 1 and 2 (PSM 1 and PSM 2) is also shown. The presently preferred PSM is a custom built PSM manufactured by Sarcos Research Corporation of Salt Lake City, Utah.

Not expressly shown in FIG. 8, but to be included in the elastic board, are modular arrangements and connections for providing power to the electrical conducting material component and for providing a light source for the penetration sensing material component. The liner in one form can be made with the sensing component(s) but without inclusion of such power and light sources, or the transmitters 52 and receivers 54 illustrated, expecting such to be separately provided and subsequently connected to the liner. In another embodiment of our invention, the virgin POF was sheathed using a flexible plastic tube and used as the penetration sensing component.

D. Operation of the Sensate Liner

The operation of the sensate liner assembly to illustrate its penetration alert and vital signs monitoring capabilities are now discussed.

Penetration Alert

1. Precisely timed pulses are sent through the POF integrated into the sensate liner.

2. If there is no rupture of the POF, the signal pulses are received by a receiver and an "acknowledgment" is sent to the PSM Unit indicating that there is no penetration.

3. If the optical fibers are ruptured at any point due to penetration, the signal pulses bounce back to the first transmitter from the point of impact, i.e., the rupture point. The time elapsed between the transmission and acknowledgment of the signal pulse indicates the length over which the signal has traveled until it reached the rupture point, thus identifying the exact point of penetration.

4. The PSM unit transmits a penetration alert via a transmitter specifying the location of the penetration.

Physical Signs Monitoring

1. The signals from the sensors are sent to the PSM Unit through the electrical conducting component (ECC) of the sensate liner.

2. If the signals from the sensors are within the normal range and if the PSM Unit has not received a penetration alert, the physical sign readings are recorded by the PSM Unit for later processing.

3. However, if the readings deviate from the normal, or if the PSM Unit has received a penetration alert, the physical sign readings are transmitted using the transmitter.

Thus, the proposed sensate liner is easy to deploy and meets all the functional requirements for monitoring body physical signs and/or penetration. The detection of the location of the actual penetration in the POF can be determined by an Optical Time Domain Reflectometer.

While the invention has been disclosed in its preferred forms, it will be apparent to those skilled in the art that many modifications, additions, and deletions can be made therein without departing from the spirit and scope of the invention and its equivalents as set forth in the following claims.

What is claimed:

1. A process for continuously weaving a full-fashioned garment, comprising the steps of:

providing at least two sets of warp threads to be used alternately, one set for the front and the other set for the back of the garment;

providing at least two sets of filling threads;

weaving a tubular structure section of the garment from the filling and warp threads along the direction of the warp threads; and weaving a double layer structure section from the filling and warp threads also along the direction of the warp threads, at least a portion of each layer of the double layer section is separated from at least a portion of each other layer of the double layer section;

the tubular structure section and the double layer structure section being woven continuously one from the other to form the garment.

2. A process as defined in claim 1, wherein the step of weaving the tubular structure section includes interlacing one thread or set of threads helically and continuously on the front and back of the garment.

3. A process as defined in claim 1, further including the step of weaving in a sensing component fiber for providing the capability of monitoring a body vital sign or penetration of the garment.

4. A process as defined in claim 3, wherein the sensing component fiber is selected from the group of optical fibers and electrical conducting fibers.

5. A process as defined in claim 3, further including the step of weaving in a form-fitting component fiber.

6. A process as defined in claim 3, further including the step of weaving in a static dissipating component fiber.

7. A process as defined in claim 1, wherein the step of weaving the double layer structure section results in armholes on either side of the garment in said double layer section.

8. A process as defined in claim 1, wherein the double layer structure is woven continuously from the tubular structure section and a second tubular structure section is woven continuously from the double layer structure section.

9. A woven garment comprising:

a tubular structure section woven along the direction of the warp threads; and a double layer structure section also woven along the direction of the warp threads, at least a portion of the each layer of the double layer section is separated from at least a portion of each other layer of the double layer section;

the tubular structure section and the double layer structure section being woven continuously one from the other to form the garment.

10. A woven garment as defined in claim 9, wherein the double layer structure section includes armholes on either side of the garment.

11. A woven garment as defined in claim 9, wherein the tubular structure section includes a thread or set of threads interlaced helically and continuously on the front and back of the garment.

12. A woven garment as defined in claim 9, further comprising a sensing component fiber for providing the capability of monitoring a body vital sign or penetration of the garment.

13. A woven garment as defined in claim 12, wherein the sensing component is selected from the group consisting of optical fibers and electrical conducting fibers.

14. A woven garment as defined in claim 9, further comprising a form-fitting component fiber.

15. A woven garment as defined in claim 9, further comprising a static dissipating component fiber.

16. A woven garment as defined in claim 9, wherein the double layer structure section is woven continuously from the tubular structure section, and a second tubular layer section is woven continuously from the double layer structure section.

17. A woven garment as defined in claim 9 wherein the tubular structure section and the double layer structure section comprise a plurality of electrically conductive fibers, the electrically conductive fibers being woven in a pattern such that signals are capable of being transmitted from one position of the garment to another position of the garment along the electrically conductive fibers.

18. A woven garment as defined in claim 17 wherein the electrically conductive material is chosen from a group of materials consisting of metallic fibers, doped inorganic materials and intrinsically conducting polymers.

19. A woven garment as defined in claim 17 further comprising a sensor and a personal status monitor, wherein the electrically conductive fibers couple the sensor to the personal status monitor so that information can be transmitted between the sensor and the personal status monitor.

20. A woven garment as defined in claim 9 wherein the garment comprises a plurality of threads that are woven into the tubular structure section and the double layer structure section, wherein at least one thread of the plurality of threads comprises an optical fiber.

21. A woven garment as defined in claim 20 wherein the optical fiber comprises a plurality of optical fibers and the plurality of optical fibers are woven in a pattern such that signals are capable of being transmitted from one position of the garment to another position of the garment along the plurality of optical fibers.

22. A woven garment as defined in claim 20 wherein further comprising a sensor and a personal status monitor, wherein the at least one thread couples the sensor to the personal status monitor so that information can be transmitted between the sensor and the personal status monitor.

23. A woven garment as defined in claim 20 wherein the at least one thread is woven such that a signal can be transmitted from one position of the garment to another position of the garment along the optical fiber.

24. A woven garment comprising:

a first tubular section being formed from a plurality of threads; and a second section continuously formed from the plurality of threads along with the first section;

the second section comprising at least two portions, the at least two portions being partially separated from each other and having at least two openings formed therein a first opening formed in one side of the second section and a second opening formed in a side of the second section opposite said first opening to form the garment.

25. A woven garment as defined in claim 24 wherein the tubular section includes a thread or set of threads interlaced helically and continuously on the front and back of the garment.

26. A woven garment as defined in claim 24 wherein the second section includes armholes on either side of the garment.

27. A woven garment as defined in claim 24 further comprising a sensing component for providing the capability of monitoring a body vital sign or penetration of the garment.

28. A woven garment as defined in claim 27, wherein the sensing component is selected from the group consisting of optical fibers and electrical conducting fibers.

29. A woven garment as defined in claim 24, wherein the plurality of threads comprises a static dissipating component fiber.

30. A woven garment as defined in claim 24, wherein the second section is woven continuously from the first section, and a third section is woven continuously from the second section.

31. A woven garment as defined in claim 24 wherein the first section and the second section comprise a plurality of electrically conductive fibers, the electrically conductive fibers being arranged in a pattern such that signals are capable of being transmitted from one position of the garment to another position of the garment along the electrically conductive fibers.

32. A woven garment as defined in claim 31 wherein a material selected for the electrically conductive fibers is chosen from a group of materials consisting of metallic fibers, doped inorganic materials and intrinsically conducting polymers.

33. A woven garment as defined in claim 31 further comprising a sensor and a personal status monitor, wherein the electrically conductive fibers couple the sensor to the personal status monitor so that information can be transmitted between the sensor and the personal status monitor.

34. A woven garment as defined in claim 24 wherein at least one thread of the plurality of threads comprises an optical fiber.

35. A woven garment as defined in claim 34 wherein the optical fiber comprises a plurality of optical fibers and the plurality of optical fibers are woven in a pattern such that signals are capable of being transmitted from one position of the garment to another position of the garment along the plurality of optical fibers.

36. A woven garment as defined in claim 34 wherein further comprising a sensor and a personal status monitor, wherein the at least one thread couples the sensor to the personal status monitor so that information can be transmitted between the sensor and the personal status monitor.

37. A process as defined in claim 7, wherein the step of weaving the double layer structure section results in an armhole having a curvature.

38. A woven garment as defined in claim 10, wherein the armhole is formed with a curvature.

39. A woven garment as defined in claim 24, wherein the openings result in armholes on either side of the garment.

40. A woven garment as defined in claim 39, wherein the armholes are formed with a curvature.

41. A woven garment as defined in claim 24, wherein the first tubular section includes a hole formed in one end thereof allowing for the passage of a head through the hole.

42. A woven garment as defined in claim 41, further having a second tubular section continuously formed from said second section at an end opposite the first tubular section, the second tubular section having a hole formed therein opposite the hole for the head.

43. A woven garment as defined in claim 24, wherein the first tubular section and the section are continuously formed along the warp direction.

* * * * *